US010667354B2

(12) United States Patent
Zhen

(10) Patent No.: US 10,667,354 B2
(45) Date of Patent: May 26, 2020

(54) ADDRESS SETTING AND SIGNAL TRANSMISSION METHOD AND LED MODULE BASED ON THE POWER LINE WORKING CONDITION

(71) Applicant: JIANGMEN PENGJIANG TIANLI NEW TECH CO., LTD., Jiangmen, Guangdong (CN)

(72) Inventor: Zhaowei Zhen, Guangdong (CN)

(73) Assignee: JIANGMEN PENGJIANG TIANLI NEW TECH CO., LTD., Jiangmen (CN)

( * ) Notice: Subject to any disclaimer, the term of this patent is extended or adjusted under 35 U.S.C. 154(b) by 0 days.

(21) Appl. No.: 16/255,886

(22) Filed: Jan. 24, 2019

(65) Prior Publication Data

US 2020/0060000 A1 Feb. 20, 2020

(30) Foreign Application Priority Data

Aug. 16, 2018 (CN) ..... 2018 1 0934996

(51) Int. Cl.
*H05B 45/10* (2020.01)

(52) U.S. Cl.
CPC ..... *H05B 45/10* (2020.01)

(58) Field of Classification Search
CPC .... H04B 2203/5404; H04B 2203/5462; H05B 37/02; H05B 33/08; H05B 33/0815; H05B 33/0842; H05B 33/0845; H05B 45/00; H05B 45/10
See application file for complete search history.

(56) References Cited

U.S. PATENT DOCUMENTS 7,929,498 B2 * 4/2011 Ozluturk ..... G06F 13/374 370/317
2014/0191682 A1 * 7/2014 Pederson ..... H04B 10/1143 315/294

* cited by examiner

*Primary Examiner* — Jimmy T Vu

(57) ABSTRACT

An address setting and signal transmission method and LED module based on the power line working condition comprising: inputting a signal flow via a power line; demodulating, by a demodulator, the signal flow into a voltage signal and a coded signal; parsing the coded signal into an address coded signal and a control coded signal; and performing address writing on the address coded signal by a first data processor to form a comparative address database and then storing same in memory. The desired light-emitting effect is obtained by means of a second data processor processing subsequent coded signals according to the comparative address database and outputting same to a load. In an LED module made according to this method, the number of power line beams is saved, and coding location of the address of a lamp bead string is implemented easily by means of coding.

3 Claims, 1 Drawing Sheet

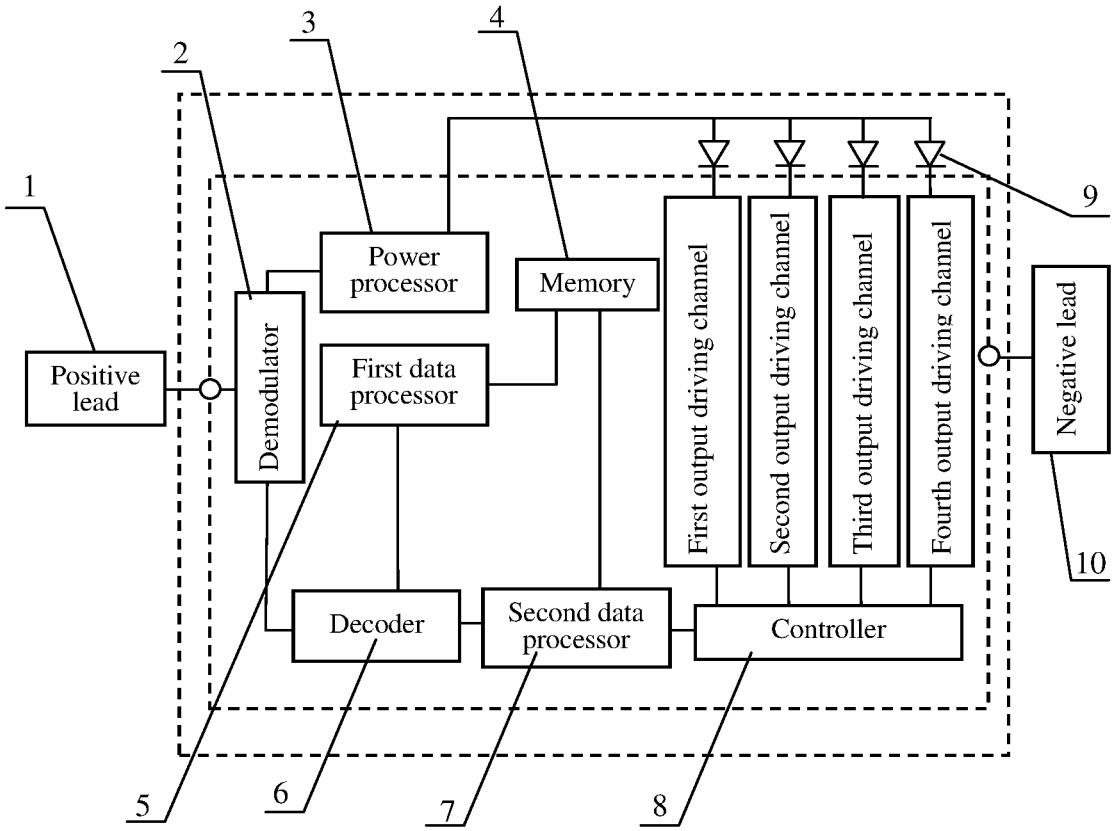
1
2
3
4
5
6
7
8
9
10
Positive lead
Demodulator
Power processor
First data processor
Memory
Decoder
Second data processor
Controller
First output driving channel
Second output driving channel
Third output driving channel
Fourth output driving channel
Negative lead

ADDRESS SETTING AND SIGNAL TRANSMISSION METHOD AND LED MODULE BASED ON THE POWER LINE WORKING CONDITION

CROSS-REFERENCE TO RELATED APPLICATIONS

The present application claims the benefit of Chinese Patent Application No. 201810934996.1 filed on Aug. 16, 2018, the contents of which are hereby incorporated by reference.

TECHNICAL FIELD

The present invention relates to a field of LED lamp control techniques, and particularly to an address setting and signal transmission method and LED module based on the power line working condition

BACKGROUND ART

With the continuous development of the society, the application of LED lamps is becoming increasingly wider. The intelligent LED lamps used at present need individual address writing, that is, the LEDs are manufactured into a lamp string after addresses are written into them, and signal lines and power lines are arranged independently, that is, at least three or more lines are necessary to complete the transmission of signals. Moreover, after the LED lamps are manufactured into the lamp string, the addresses of the LED lamps in the lamp string cannot be changed online, which causes the LED lamp string difficult to be encoded and located in a large setting project and thus a low efficiency.

SUMMARY OF THE INVENTION

In view of the above defects existing in the prior art, the technical problems to be solved in the present invention is to provide an address setting and signal transmission method and LED module based on the power line working condition, so as to solve the problems of harder coding and low efficiency of LED strings in a large LED setting project.

In order to solve the above technical problems, an address setting and signal transmission method based on the power line working condition, comprising: inputting a signal flow via a power line; demodulating, by a demodulator, the signal flow into a electric power signal and a coded signal; parsing the coded signal into an address setting signal and a control signal; and performing address writing on the address setting signal by a first data processor to generate a comparative address database and then storing same in a memory.

Preferably, parsing the coded signal by a decoder into the address setting signal or a control signal; parsing out the an address data according to the address setting signal by the first data processor; and parsing out control instructions according to the control signal together with the address database data stored in the memory by the second data processor.

In order to solve the above technical problems, the present invention further provides an LED module based on power line address setting and control signal transmission, comprising:

a positive lead which is electrically connected to an output end of a supply power line and is used for receiving a signal flow from the supply power line;

a demodulator which is electrically connected to the positive lead and is used for demodulating the signal flow into a electric power signal and a coded signal;

a decoder which is electrically connected to the demodulator and is used for parsing the coded signal to obtain an address setting signal or a control signal;

a first data processor for performing address setting processing on the address setting signal to form a comparative address database;

a second data processor for generating instructions to a controller on the basis of the control signal from the decoder and a relating address data from a memory;

a power processor for processing the electric power signal from the demodulator and then supply the electric power to related devices;

Memory which is electrically connected to the first data processor and the second data processor respectively, is used for storing the comparative address database from the first data processor or sending the address data to the controller;

The controller which is electrically connected to the second data processor and the power processor respectively, is used for controlling the brightness and display of light emitting diodes;

A negative lead which is electrically connected to the negative output ends of the controller and the other devices in the module.

Preferably, the first data processor and the second data processor are electrically connected to the decoder and the power processor respectively; and the controller is further used for receiving the control signal and performing shaping processing.

Preferably, the LED module further comprises four output driving channels from the controller and four groups of the light emitting diodes; the four output driving channels comprise a first driving channel, a second driving channel, a third driving channel and a fourth driving channel; the four groups of the light emitting diodes comprise a first group of light emitting diode, a second group of light emitting diode, a third group of light emitting diode and, a fourth group of light emitting diode; wherein the first output driving channel is electrically connected to the first group of light emitting diode, the second output driving channel is electrically connected to the second group of light emitting diode, the third output driving channels is electrically connected to the third group of light emitting diode, the fourth output driving channel is electrically connected to the fourth group of light emitting diode. With the above technical solution that is intended to provide the address setting and signal transmission method based on the power line working condition, a signal flow is demodulated into a coded signal and a electric power signal, and then address setting and storage comparison are performed on the coded signal, the electric current in a power line is used as a carrier for the coded signal, and the normal electric power signal and the coded signal share the power line. A branch circuit for the coded signal performing further processing on the coded signal can also achieve the light-emitting effect of controlling LEDs by different signal circuits in the prior art. The LED module based on power line transmission control signals and address signals integrates a control circuit of a general LED circuit with a second data processor, and on this basis a coding branch and a storage are integrated and the signal source of the coding branch is transmitted by a power line, thereby saving the design of line beams of an LED lamp string and the envelope process, and the use of the original circuit of the module to perform the coding operation can also show the light-emitting effect of the LED lamp string timely while encoding it, which also facilitates the application of LED lamp strings in a large construction project.

BRIEF DESCRIPTION OF THE DRAWINGS

The sole FIGURE is a structure diagram of an LED module based on power line transmission control signals and address signals of the present invention;

in the FIGURE, 1—Positive lead, 2—Demodulator, 3—Power processor, 4—Memory, 5—First data processor, 6—Decoder, 7—Second data processor, 8—Controller, 9—Light emitting diode, 10—Negative lead.

DETAILED DESCRIPTION OF EMBODIMENTS

The detailed description of embodiments of the present invention will be further illustrated below in conjunction with the accompanying drawing. It is to be noted here that, the description of these embodiments is used to help understand the present invention, but does not constitute a limitation on the present invention. In addition, the technical features involved in the various embodiments of the present invention described below can be combined with each other as long as there is no conflict between them.

As shown in the FIGURE, in the structure diagram of the LED module based on power line transmission control signals and address signals of the present invention, the LED module comprises a positive lead 1, a demodulator 2, a power processor 3, memory 4, a first data processor 5, a decoder 6, a second data processor 7, a controller 8, a light emitting diode 9, and a negative lead 10, wherein the positive lead 1 is electrically connected to an output end of a supply line power, the demodulator 2 is electrically connected to the positive lead 1, the decoder 6 and the power processor 3, respectively, the decoder 6 is electrically connected to the first data processor 5 and the second data processor 7, respectively, both the first data processor 5 and the second data processor 7 are electrically connected to the memory 4 and the controller 8, and the negative lead 10 is electrically connected to an output end of the controller 8; and the LED module further comprises a first output driving channel, a second output driving channel, a third output driving channel and a fourth output driving channel which are electrically connected to the light emitting diode 9 and the controller 8, respectively.

Particularly, the positive lead 1 is used for receiving an input signal from the supply line power, wherein the input signal includes a signal flow, such as the voltage amplitude, the frequency and the wave length; the demodulator 2 demodulates the a electric power signal and a coded signal according to a signal format in the signal flow; the coded signal enters into a coding branch (including the memory 4, the first data processor 5 and the decoder 6), and the decoder 6 is used to perform decoding processing on the input signal in an address writing signal format; the first data processor 5 is used to perform address setting processing on the address setting signal to generate a comparative address database and store a processed comparative address database in the memory 4; the power processor 3 processing the electric power signal from the demodulator and then supply the electric power to related devices. And the controller 8 is used to output a control signal to the light emitting diode 9 according to the processed input signal and control the brightness and display of the light emitting diode 9. The second data processor 7 performs the integrated analysis and dispatching on the control signal from the decoder and the address setting signal, and compares same with the coded address in the comparative address database, and then issues an integrated light-emitting instruction to the controller 8, so as to obtain the desired light-emitting effect.

The controller 8 is further used to perform shaping processing on the control signal; and the power processor 3 is further used to determine whether the voltage of the input signal exceeds a preset voltage range, thereby protecting the LED circuit. The light emitting diode 9 comprises a first light emitting diode, a second light emitting diode, a third light emitting diode and a fourth light emitting diode, and the first output driving channel, the second output driving channel, the third output driving channel and the fourth output driving channel are electrically connected to the first light emitting diode, the second light emitting diode, the third light emitting diode and the fourth light emitting diode, respectively; an output end of the first output driving channel is electrically connected to an cathode of the first light emitting diode, an output end of the second output driving channel is electrically connected to an cathode of the second light emitting diode, an output end of the third output driving channel is electrically connected to an cathode of the third light emitting diode, and an output end of the fourth output driving channel is electrically connected to an cathode of the fourth light emitting diode.

In actual operation, a signal flow via the power line will be demodulated by demodulator 2 into an electrical power and the coded signal. The coded signal will be parsed by the decoder 6 into the address setting signal or the control signal. The address setting signal will be parsed by the first data processor 5 into the address data then store in the memory 4. The control signal will be parsed by a second data processor 7 together with the address data from the memory 4 into the control instructions for the controller 8.

In combination with the FIGURE, when the address setting and signal transmission method based on the power line working condition provided in the present invention is applied to a light-emitting module manufactured in a chip of the LED lamp, it is only necessary to integrate the output end of the demodulator 2 and the input end of the second data processor 7 in the coding branch, and it is to be specially noted that an additional negative lead can also be extracted from the output end of the storage, so as to facilitate the separate coding of the coding branch. Of course, it can also share a negative lead with the entire circuit. The negative lead 1 is arranged on the input lead of the LED lamp; the demodulator 2 can be a phase-sensitive rectifier demodulator, a phase-sensitive amplification demodulator and so on; the decoder 6 comprises a code translator and so on; the first data processor 5 is used for performing address setting processing on the address setting signal; the second data processor 7 is used for processing the integrated coded signal; and the power processor 3 can be a ULV processor and so on, which is used to perform the voltage analysis processing according the input signal having different voltages.

In the above embodiments, the output ends of the first, the second, and the third output driving channel are electrically connected to the first, the second, and the third light emitting diode to control the lighting of lamp beads, which is familiar to a person skilled in the art and will be not described here.

The embodiments of the present invention are described in detail above in combination with the drawings, but the present invention is not limited to the described embodiments. For a person skilled in the art, various changes, modifications, substitutions and variants of these embodiments still fall within the scope of protection of the present invention without departing from the principles and spirit of the present invention.

The invention claimed is:

1. An address setting and signal transmission method based on a power line working condition, comprising:

inputting a signal flow via a power line; demodulating, by a demodulator, the signal flow into an electric power signal and a coded signal; parsing the coded signal into an address setting signal or a control signal; and performing address setting on the address setting signal by a first data processor to generate a comparative address database and then storing the comparative address database into a memory.

2. The address setting and signal transmission method based on the power line working condition according to claim 1, wherein parsing the coded signal by a decoder into the address setting signal or the control signal; parsing out an address data according to the address setting signal by the first data processor; parsing out control instructions according to the control signal together with the address database stored in the memory by the second data processor.

3. The address setting and signal transmission method based on the power line working condition according to claim 2, wherein:

the demodulator is used for demodulating the signal flow into the electric power signal and the coded signal;

the decoder is used for parsing the coded signal to obtain the address setting signal or the control signal;

the first data processor is used for performing address setting processing on the address setting signal to form the comparative address database;

the second data processor is used for generating instructions to a controller on the basis of the control signal from the decoder and a relating address data from the memory;

the memory is used for storing the comparative address database from the first data processor or sending the address data to the controller; and the controller is used for controlling a brightness and display of light emitting diodes;

the controller is further used for receiving the control signal and performing shaping processing.

* * * * *